US006601516B2

(12) United States Patent
Harrington et al.

(10) Patent No.: US 6,601,516 B2
(45) Date of Patent: Aug. 5, 2003

(54) LOW ENERGY FUSE

(75) Inventors: David Lee Harrington, Fairfield, CA (US); Steven William McDonald, Fairfield, CA (US); Michael Howard Tolson, Vacaville, CA (US); Leonard Macon Smith, Vacaville, CA (US)

(73) Assignee: Goodrich Corporation, Charlotte, NC (US)

( * ) Notice: Subject to any disclaimer, the term of this patent is extended or adjusted under 35 U.S.C. 154(b) by 170 days.

(21) Appl. No.: 09/823,471

(22) Filed: Mar. 30, 2001

(65) Prior Publication Data

US 2002/0170454 A1 Nov. 21, 2002

(51) Int. Cl.[7] ..... C06C 7/00
(52) U.S. Cl. ..... 102/275.9
(58) Field of Search ..... 102/275.3, 275.8, 102/275.9, 275.11

(56) References Cited

U.S. PATENT DOCUMENTS

| | | | | |
|---|---|---|---|---|
| 3,590,739 A | | 7/1971 | Persson | |
| 3,908,549 A | * | 9/1975 | Turner et al. | 102/27 R |
| 4,290,366 A | | 9/1981 | Janoski | |
| 4,316,415 A | | 2/1982 | Baker | 102/275.8 |
| 4,328,753 A | | 5/1982 | Kristensen et al. | |
| 4,924,774 A | | 5/1990 | Lenzen | 102/202.7 |
| 5,010,821 A | | 4/1991 | Blain | 102/275.8 |
| 5,048,420 A | | 9/1991 | Beck et al. | |
| 5,166,470 A | | 11/1992 | Stewart | |
| 5,317,974 A | | 6/1994 | Stewart et al. | |
| 5,629,493 A | | 5/1997 | Andersson et al. | |
| 5,844,322 A | | 12/1998 | Andersson et al. | |

FOREIGN PATENT DOCUMENTS

| | | |
|---|---|---|
| EP | 0327219 | 8/1989 |
| JP | 54100477 | 8/1979 |

OTHER PUBLICATIONS

Murthy, N.S. et al. Effect of Hexafluroisobutylene Moieties on the Structure and Properties of Copolymers of Ethylene and Chlorotrifluoroethylene, Polymer Pub., May 1988, vol. 29, No. 5, pp. 829–832. (Abstract Only).

Pipe Material Used For Hot Wet Fluids—Comprises Laminate of Ethylene]–Fluorocarbon] Copolymer And Rubber Outer Layer, Derwent Publications Ltd., London, 1979. (Abstract Only).

* cited by examiner

*Primary Examiner*—John Hardee
(74) *Attorney, Agent, or Firm*—Jerry Holden

(57) ABSTRACT

Low energy fuse for use in transmitting shock waves. The fuse consists of a hollow plastic tube fabricated of an ethylene-chlorotrifluoroethylene terpolymer, with a coating of reactive powder on an inner wall of the tube. The terpolymer contains a third polymer which enhances adhesion of the powder to the tube, and in the disclosed embodiment, the third polymer is hexafluoroisobutylene.

16 Claims, 1 Drawing Sheet

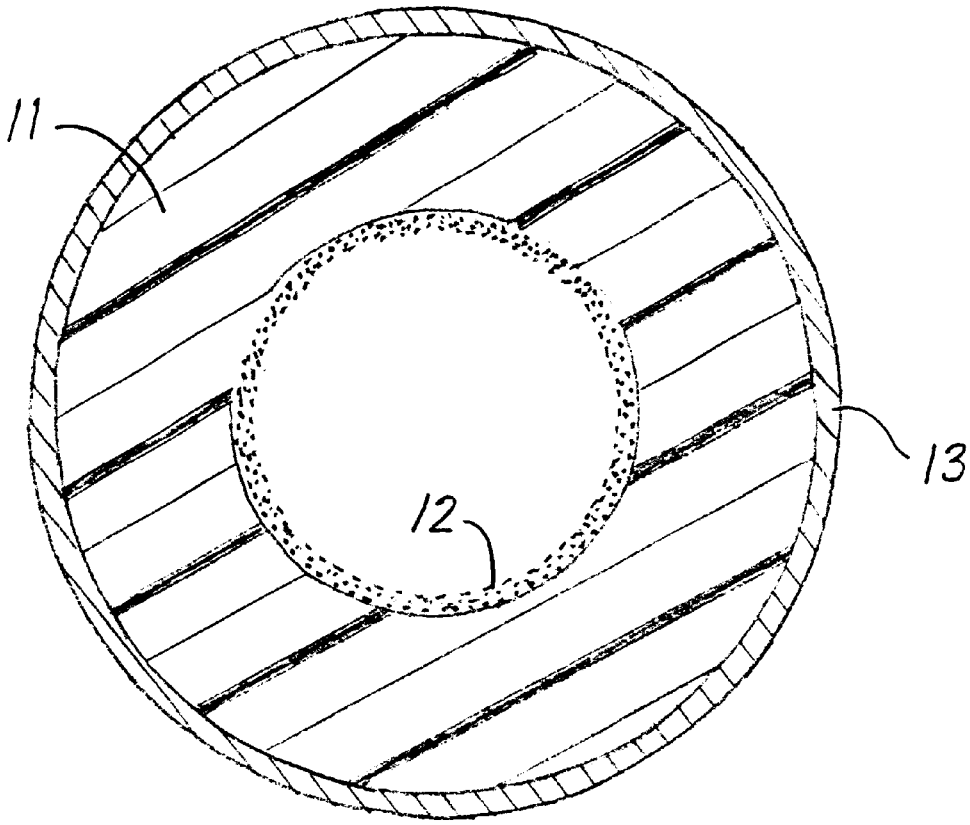
11
12
13

LOW ENERGY FUSE

This invention pertains generally to explosive and ignitive devices and, more particularly, to a low energy fuse for use in transmitting shock waves.

Low energy fuses are employed in aerospace and other applications for transferring an explosive signal from one location to another and in providing precise delays or timing relationships between different energetic reactions which are initiated by the explosive signal. Examples of such fuses are found in U.S. Pat. Nos. 3,590,739, 4,290,366, 4,328,753, 5,048,420, 5,166,470, 5,317,974 and 5,844,322.

These low energy fuses typically consist of a hollow plastic tube with a reactive material distributed along the length of the tube for sustaining a shock wave. The reactive material is commonly in a pulverulent or powdered form and is coated onto the inner wall or surface of the tube. The tube must have sufficient strength to avoid collapse or other damage prior to rapid deflagration, and to remain intact during use. There must also be proper adhesion between the tube and the powder so that the powder will remain in place on the wall of the tube.

Heretofore, there have been some attempts to provide both strength and adhesion by the use of laminated plastic tubes comprising an inner layer with good adhesion properties and an outer layer which provides mechanical strength and reinforcement. An example of this laminated structure is found in U.S. Pat. No. 4,328,753.

Other fuses have employed a single ply plastic tube with an adhesion enhancer. U.S. Pat. No. 5,317,974, for example, discloses a single ply tube which is fabricated of a draw orientable polymer resin with a modifier in the extrusion melt for imparting an improved powder retaining capability to the tube.

It is in general an object of the invention to provide a new and improved low energy fuse for transmitting shock waves.

Another object of the invention is to provide a low energy fuse of the above character which has improved adhesion properties for the reactive powder coating that is distributed along the length of the fuse.

These and other objects are achieved in accordance with the invention by providing a low energy fuse having a hollow plastic tube fabricated of an ethylene-chlorotrifluoroethylene terpolymer, with a coating of reactive powder on an inner wall of the tube. The terpolymer contains a third polymer which enhances adhesion of the powder to the tube, and in the disclosed embodiment, the third polymer is hexafluoroisobutylene.

BRIEF DESCRIPTION OF THE DRAWING

The single FIGURE of drawing is an enlarged cross-sectional view of one embodiment of a low energy fuse incorporating the invention.

As illustrated in the drawing, the low energy fuse comprises an elongated hollow plastic tube 11 with a coating of pulverulent reactive material 12 on the inner wall or surface of the tube. For some applications, the tube is overbraided with a layer of stainless steel wire 13 to provide additional abrasion protection and tensile strength. For applications in which the additional protection is not required, the overbraid can be omitted.

The tube is fabricated by extrusion of a fluorinated polymer, i.e. a thermoplastic polymer in which some of the hydrogen has been replaced by fluorine. The fluorinated polymer is preferably an ethylene-chlorotrifluoroethylene terpolymer which contains a third polymer that enhances the adhesion of the powder to the tube. In the presently preferred embodiment, the terpolymer consists essentially of a substantially homogeneous blend of ethylene, chlorotrifluoroethylene, and hexafluoroisobutylene. A suitable terpolymer for this purpose is Ausimont's HALAR® 600 ECTFE, which is a 1:1 alternating copolymer of ethylene and chlorotrifluoroethylene with up to 5 percent by weight grafted HFIB on the polymer backbone.

Somewhat surprisingly, the terpolymer with the hexafluoroisobutylene (HFIB) has been found to provide significantly better adhesion for the reactive powder than an ethylene-chlorotrifluoroethylene copolymer such as Ausimont's HALAR® 300 ECTFE which does not have the HFIB. Repeated experiments with the HALAR® 600 ECTFE have shown a remarkable improvement over the HALAR® 300 ECTFE. It is believed that the HFIB was added to the copolymer to reduce shrinkage when the plastic is used as a coating material on metal, and it is not understood why it enhances powder adhesion on the extruded plastic tube.

The tube typically has an inside diameter of about 1.0 to 1.5 mm, and a wall thickness on the order of 0.5 to 1.0 mm.

The reactive material consists of an admixture of oxidizers such as perchlorates, permanganates and peroxides; secondary high explosives such as pentaerythritoltetranitrate (PETN), cyclotrimethylenetrinitramine (RDX), cylcotetramethylenetetranitramine (HMX), trinitrotoluene (TNT), and dinitroethylurea; and metal or quasi-metal fuels such as aluminum and silicon. One presently preferred reactive material is a mixture of HMX and aluminum, with about 75 to 90 percent HMX and 10 to 25 percent aluminum being most preferable.

EXAMPLE

A homogeneous mixture of 75 to 90 percent HMX and 10 to 25 percent aluminum is deposited on the inner wall of an extrusion of HALAR® 600 ECTFE at a loading density of approximately 20 mg/meter of tubing. The tubing has an outer diameter of about 0.120 inch and an inner diameter of about 0.040 inch.

The improvement provided by using HALAR® 600 ECTFE versus HALAR® 300 ECTFE has been demonstrated by coating tubes of each type with similar initial loads and vibrating the tubes to remove excess or free moving reactive material. The results are summarized in the following table:

| Material | Total Core Load (mg/meter) | Vibrated Core Load (mg/meter) | Vibrated VOD (meters/sec) |
|---|---|---|---|
| HALAR ® 300 | 17.9 | 5.5 | 1600 |
| HALAR ® 600 | 15.5 | 12.76 | 2014 |

As these FIGURE show, with the HALAR® 600 ECTFE material, retention of the reactive material on the inner wall of the tubing is improved by about 132 percent, and the velocity of defragation (VOD) is improved by about 26 percent.

The invention has a number of important features and advantages. The inclusion of the hexafluoroisobutylene (HFIB) in the terpolymer provides a remarkable enhancement in the adhesion of the reactive material. Being fabricated of a single homogeneous material, the tube is relatively economical and easy to manufacture, and it has good mechanical strength as well as good adhesion.

It is apparent from the foregoing that a new and improved low energy fuse has been provided. While only certain presently preferred embodiments have been described in detail, as will be apparent to those familiar with the art, certain changes and modifications can be made without departing from the scope of the invention as defined by the following claims.

What is claimed is:

1. A low energy fuse for transmitting shock waves comprising:

a hollow plastic tube fabricated of a terpolymer consisting essentially of ethylene, chlorotrifluoroethylene, and hexafluoroisobutylene, and a coating of pulverulent reactive material on an inner wall of the tube.

2. The low energy fuse of claim 1, wherein the ethylene and chlorotrifluoroethylene are present in the terpolymer in substantially equal amounts.

3. The low energy fuse of claim 1, wherein the reactive material comprises a mixture of about 75 to 90 percent cylcotetramethylenetetranitramine (HMX) and about 10 to 25 percent aluminum.

4. The low energy fuse of claim 1, wherein the ethylene and chlorotrifluoroethylene are present in the terpolymer in substantially equal amounts, and wherein the hexafluoroisobutylene is present in the termpolymer in an amount sufficient to enhance the adhesion of the pulverulent reactive material to the tube.

5. The low energy fuse of claim 1, wherein the tube is overbraided with a layer of stainless steel wire.

6. The low energy fuse of claim 1, wherein the tube has a wall thickness of about 0.5 to 1.0 mm.

7. A low energy fuse for transmitting shock waves comprising:

a hollow plastic tube consisting essentially of:

an ethylene-chlorotrifluoroethylene terpolymer containing substantially equal amounts of ethylene and chlorotrifluoroethylene, and an amount of hexafluoroisobutylene, the tubing having in inner diameter of about 0.040 inch and an outer diameter of about 0.120 inch, and a coating of pulverulent reactive material comprising a homogeneous mixture of about 75 to 90 percent cylcotetramethylenetetranitramine (HMX) and about 10 to 25 percent aluminum on an inner wall of the tube.

8. The low energy fuse of claim 7, wherein the tube is overbraided with a layer of stainless steel wire.

9. The low energy fuse of claim 7, wherein the tube has a wall thickness of about 0.5 to 1.0 mm.

10. A low energy fuse for transmitting shock waves comprising:

a hollow plastic tube fabricated of a terpolymer containing hexafluoroisobutylene, and a coating of pulverulent reactive material on an inner wall of the tube.

11. The low energy fuse of claim 10, wherein the reactive powder comprises a homogeneous mixture of about 75 to 90 percent cylcotetramethylenetetranitramine (HMX) and about 10 to 25 percent aluminum.

12. The low energy fuse of claim 10, wherein the tube is overbraided with a layer of stainless steel wire.

13. A low energy fuse for transmitting shock waves comprising:

a hollow plastic tube fabricated of an ethylene-chlorotrifluoroethylene terpolymer, and a coating of reactive powder on an inner wall of the tube, wherein the terpolymer contains a third polymer which enhances adhesion of the powder to the tube.

14. The low energy fuse of claim 13, wherein the reactive powder comprises a homogeneous mixture of about 75 to 90 percent cylcotetramethylenetetranitramine (HMX) and about 10 to 25 percent aluminum.

15. The low energy fuse of claim 13, wherein the tube is overbraided with a layer of stainless steel wire.

16. The low energy fuse of claim 13, wherein the tube has a wall thickness of about 0.5 to 1.0 mm.

* * * * *

UNITED STATES PATENT AND TRADEMARK OFFICE

CERTIFICATE OF CORRECTION

PATENT NO. : 6,601,516 B2 
DATED : August 5, 2003
INVENTOR(S) : David Lee Harrington et al.

It is certified that error appears in the above-identified patent and that said Letters Patent is hereby corrected as shown below:

Column 2,
Line 58, the number should be changed from "132" to -- 232. --

Signed and Sealed this

Fourteenth Day of October, 2003

JAMES E. ROGAN
*Director of the United States Patent and Trademark Office*